US007338390B2

(12) United States Patent
Lindsay

(10) Patent No.: US 7,338,390 B2
(45) Date of Patent: Mar. 4, 2008

(54) MULTI-MATERIAL GOLF CLUB HEAD

(75) Inventor: Howard Alvin Lindsay, Scottsdale, AZ (US)

(73) Assignee: Vyatek Sports, Inc., Scottsdale, AZ (US)

( * ) Notice: Subject to any disclaimer, the term of this patent is extended or adjusted under 35 U.S.C. 154(b) by 0 days.

(21) Appl. No.: 10/712,401

(22) Filed: Nov. 12, 2003

(65) Prior Publication Data

US 2004/0147342 A1 Jul. 29, 2004

Related U.S. Application Data

(60) Provisional application No. 60/425,244, filed on Nov. 12, 2002.

(51) Int. Cl.
*A63B 53/04* (2006.01)
*A63B 53/06* (2006.01)

(52) U.S. Cl. ..... 473/345; 473/335; 473/342; 473/348

(58) Field of Classification Search ..... 473/324–350
See application file for complete search history.

(56) References Cited

U.S. PATENT DOCUMENTS 4,618,149 A 10/1986 Maxel
4,730,830 A 3/1988 Tilley
4,928,972 A * 5/1990 Nakanishi et al. ..... 473/332
5,094,383 A * 3/1992 Anderson et al. ..... 228/176
5,184,823 A * 2/1993 Desboilles et al. ..... 473/345
5,261,664 A * 11/1993 Anderson ..... 473/342
5,288,070 A * 2/1994 Chen ..... 473/331
5,351,958 A * 10/1994 Helmstetter ..... 473/346
5,410,798 A * 5/1995 Lo ..... 29/527.2
5,472,201 A * 12/1995 Aizawa et al. ..... 473/329
5,489,098 A * 2/1996 Gojny et al. ..... 473/342
5,720,673 A * 2/1998 Anderson ..... 473/342
5,769,735 A * 6/1998 Hosokawa ..... 473/332
RE35,955 E * 11/1998 Lu ..... 473/329
6,183,377 B1 * 2/2001 Liang ..... 473/324
6,533,679 B1 * 3/2003 McCabe et al. ..... 473/335
6,776,723 B2 * 8/2004 Bliss et al. ..... 473/291

FOREIGN PATENT DOCUMENTS

WO WO 92/22356 12/1992
WO WO 01/38562 5/2001

* cited by examiner

*Primary Examiner*—Alvin A Hunter
(74) *Attorney, Agent, or Firm*—Snell & Wilmer L.L.P.

(57) ABSTRACT

A golf club head in accordance with various aspects of the present invention, may have a higher volume and/or higher strength. The golf club head may comprise a frame structure with a composite matrix. The golf club head may also comprise a detachable face, allowing various faces of differing materials to be attached to the body. A detachable face further allows the head to be tuned via placement/rearrangement of weights within the head to change the center of gravity and moment of inertia.

5 Claims, 3 Drawing Sheets

MULTI-MATERIAL GOLF CLUB HEAD

CROSS-REFERENCE TO RELATED APPLICATIONS

This application claims priority to U.S. Provisional Patent Application Ser. No. 60/425,244 entitled "Multi-Material Hybrid Golf Club Head Design/Construction," filed Nov. 12, 2002, which is incorporated herein by reference.

FIELD OF THE INVENTION

The present invention relates to golf club heads having detachable faces, and more particularly, to a golf club heads constructed of multiple materials and methods for manufacturing the same.

BACKGROUND OF THE INVENTION

Current high-performance golf club heads are often manufactured from substantially unitary metal or graphite structures. In attempts to maintain low weight, while having large volumes, in the case of drivers (commonly referred to as "woods"), the heads are often made of materials such titanium, steel or graphite composites.

Many performance characteristics are desirable in the case of driver heads, including size, strength, mass distribution/inertia properties and sound. For example, generally, as the size of the heads increases (many approaching 500 cc), the heads tend to be more "forgiving" for off-center hits.

Higher strength heads, particularly with respect to the face of the head, are likewise desirable as reduction of the combined deflection of the face and ball upon impact preserves energy from club to ball. Stated otherwise, using stronger, yet thinner materials in the face provides the ability to decrease the deflection in the ball (where the most energy loss occurs) by increasing the deflection in the face. To that end, faces have been manufactured from stronger materials than the remainder of the head. For example, some heads have faces manufactured of materials such as Beta titanium, which are welded to head bodies made of weaker materials such as cast titanium.

Further still, more and more, golfers seek club heads with specific centers of gravity locations and moments of inertia to control drive characteristics. Further yet, golfers increasingly seek to change certain subjective characteristics such as the sound made upon impact between the club head and the ball. For example, some golfers prefer the hollow "ping" sound of a titanium driver, while others prefer the "dead" or solid sound of a composite head (more like a traditional wood driver).

These various performance attributes combine to allow club designers to tune or enhance certain characteristics of club performance. However, conventional metal design/construction methods are limited by basic properties (e.g., stiffness, strength and density) of the metal as well as by manufacturing limitations (e.g., casting, welding and forming). Similarly, composite heads have limitations including durability "out of plane" or perpendicular to the fiber plane. For example, loads at impact tend to de-laminate the composite layers and yet, when a design is created with sufficient strength to survive the impact loads, the resulting face is very thick which increases stiffness causing more deflection in the ball reducing the conversion of energy to the ball at impact.

Thus, while the above-mentioned attributes are sought, many remain unrealized. Improved heads which can vary stiffness and strength areas redistribute total weight allowing control of the location of center of gravity and moment of inertia and/or are made of lighter and stronger materials, allowing bigger club heads with correspondingly larger "sweet" spots. Further still, clubs which provide "tunable" centers of gravity and moments of inertia are also desirable. Such clubs may be further capable of producing varying impact sounds, and are therefore desirable.

SUMMARY OF THE INVENTION

While the way that the present invention addresses the disadvantages of the prior art is discussed in greater detail below, in general, the present invention provides an improved golf club head. For example, a golf club head in accordance with various aspects of the present invention, may be manufactured with a higher volume and have stronger characteristics allowing redistribution of the total weight to control the location of the center of gravity and/or moment of inertia and/or which weigh less, allowing additional weight to be added to specific locations on the clubs, thereby allowing the center of gravity and moment of inertia to be controlled/adjusted. For example, the golf club head may comprise a frame structure and a composite matrix. The golf club head also may have a detachable face, allowing various faces of differing materials to be attached to one body. A detachable face further allows the head to be tuned via placement/rearrangement of weights within the head to change the center of gravity and moment of inertia as well as sound.

BRIEF DESCRIPTION OF THE DRAWINGS

A more complete understanding of the present invention may be derived by referring to the detailed description when considered in connection with the Figures, where like reference numbers refer to similar elements throughout the Figures, and.

DETAILED DESCRIPTION

The following description is of exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth herein. For example, though various portions of the specification refer to particular materials used in connection with golf club heads, numerous other materials, now known or as yet unknown, having desirable properties should be considered within the scope of the present invention.

Additionally, briefly, each and every process for manufacturing hollow items from various materials is not explained herein, however, one skilled in the relevant art will appreciate that various conventional metal and/or composite forming techniques may be used in accordance with the present invention.

Figure 1:
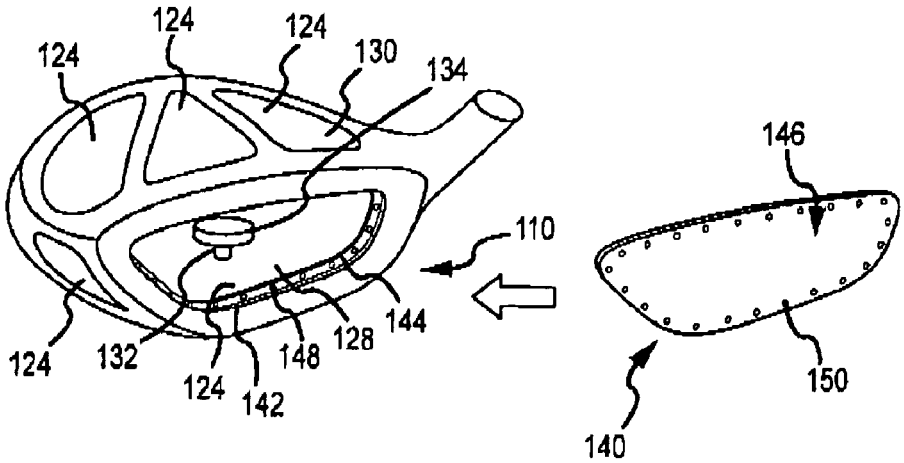
FIG. 1 is a perspective view of a body combination of a golf club head in accordance with the present invention.

That being said, in accordance with various aspects of the present invention and with reference to the exemplary embodiment illustrated in FIG. 1, the present invention comprises a golf club head 100 having a body combination structure 110 further comprising a body frame structure 120 defining an outer surface 122 of golf club head 100 and encompassing a filler matrix 130 contiguous with an inner surface of said body frame structure 110.

Figure 2:
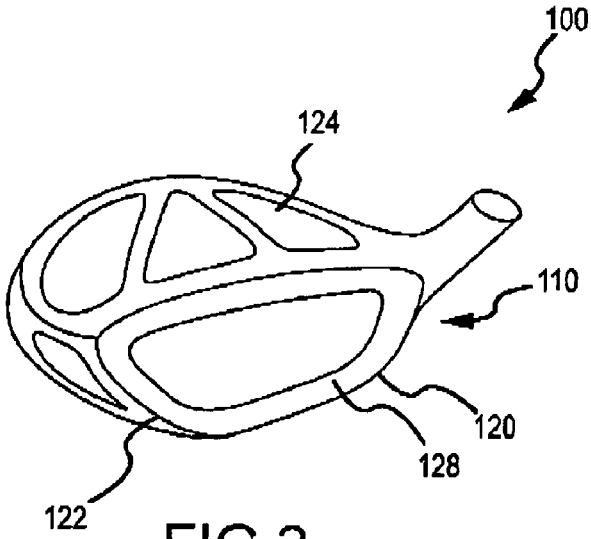
FIG. 2 is a perspective view of a frame structure of a golf club head in accordance with the present invention.

With reference to the exemplary embodiment of FIG. 2, frame structure 120 comprises an exoskeleton which suitably defines a general shape of golf club head 100, with outer surface 122 generally defining an outer surface perimeter of golf club head 100. In accordance with various embodiments, frame structure 120 comprises a lightweight, strong material such as titanium. In accordance with various embodiments of the present invention, frame structure may be manufactured in any manner now known or as yet unknown. For example, frame structure 120 may be cast as one piece, stamped or cut, or comprise numerous such pieces welded together. Additionally, an exemplary frame structure 120 in accordance with the present invention has walls having a thickness of about 0.030 to about 0.100 inches. The exoskeleton provides a number of apertures 124 through frame structure 122 formed casting, stampings, welding or other known or as yet unknown fabrication methods. Apertures 124 thus assist in minimization of the weight of the metal portion of head 100 as less material is used to form frame structure 120.

In accordance with various exemplary embodiments of the present invention, filler matrix 130 comprises a composite material such as plastic, graphite, fiberglass, epoxy or any of numerous now known or as yet unknown composite materials, generally selected based on desired properties.

Filler matrix 130 is suitably formed inside frame structure 120. For example, using various processes (such as those described herein) for creating composite devices, filler matrix 130 is suitably bonded to inner surface of frame structure 120 such that filler matrix 130 and frame structure 120 form body combination structure 110. In accordance with various exemplary embodiments, portions of filler matrix 130 extend through apertures 124. In such embodiments, an outer surface 132 of filler matrix 130 is substantially continuous with outer surface 122 of frame structure 120. Continuity can occur from a number of manners including via a molding process, various finishing steps and the like. As such, combination body 110 comprising frame 122 connected to filler matrix 130 is thus provided.

Figure 3:
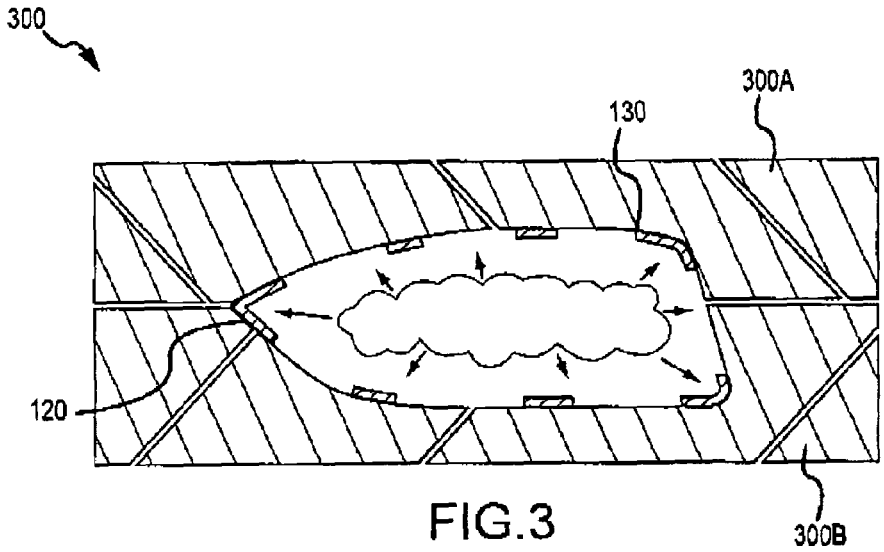
FIG. 3 is an exemplary embodiment of a mold and body combination in accordance with the present invention.

For example, with reference now to FIG. 3, in an exemplary embodiment, frame structure 120 and filler matrix 130 combination may be placed into a female mold 300 and filler matrix 130 is pressurized or otherwise caused to expand (e.g., through placement in a press or oven) and is thus bonded to frame structure 120, creating one integrated component-body combination 110. Momentarily, however, in accordance with alternative embodiments of that present invention, filler matrix 130 need not be molded with frame structure 120, but rather, they may be secondarily bonded together. As such, it should be appreciated that any number of manufacturing methods may be used in accordance with the assembly of frame structure 120 and filler matrix 130.

Generally, mold 300 comprises any suitably rigid device having an inner diameter configured in the general shape of club head 100. Such molds are commonly known and often comprises two halves 300A, B such as those illustrated in FIG. 3. As such, molds 300A, B assist in creating a desired finish on the outer surface of club head 100. Other improvements to the fabrication may also be realized.

Figure 4:
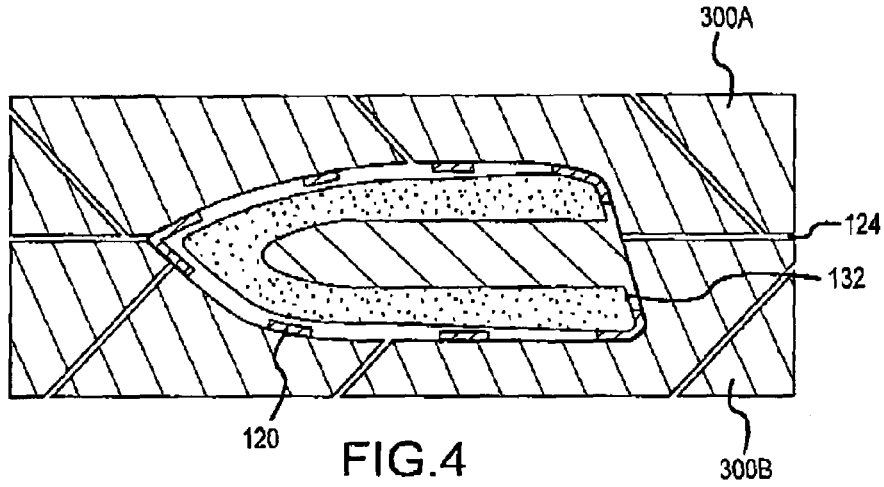
FIG. 4 is another exemplary embodiment of a mold and body combination in accordance with the present invention.

For example, in an exemplary embodiment such as is illustrated in FIG. 4, the molding process may comprise placing layers of the composite material used in filler matrix 130 over an inflatable bladder 132 (commonly made of nylon, latex, silicone or the like), placing bladder 132 and filler matrix 130 within frame structure 120 and pressurizing bladder 132 to consolidate (i.e., squeeze) filler matrix 130 against the inner surface of frame structure 120. As is generally known, this inflation method may use various pressurization techniques including a process called "trapped rubber molding" where the composite layers are wrapped around a rubber (usually silicone) mandrel, placed in a high temperature oven, and heated. The internal pressure, for example, due to a high coefficient of thermal expansion of the mandrel, forces filler matrix 130 against inner surface of frame structure 120, bonding the two materials together and forcing a portion of filler matrix 130 through apertures 124 and pushing the layers directly against the surface of mold 300. A separate "plug" assembly 134 is used to facilitate placing rubber mandrel 132 assembly inside the cavity of frame structure 120 and to aid in extraction after cure. Plug 134 is removed first after cure allowing rubber mandrel 132 to collapse slightly and be removed. Body combination 110 is then removed from the mold assembly and filler matrix 130 is visible through apertures 124.

Additionally, in accordance with still further aspects of the present invention and as mentioned above, body combination 110 may be suitably machined, ground or otherwise processed to clean up any minor transition discontinuities between the two materials.

In any event, it should thus be appreciated that any number of "molding" operations, secondary bonding operations or other manufacturing methods such as those now known or as yet unknown may be used in the context of the present invention.

Thus, in accordance with the present invention, the orientation and amount of filler matrix 130 and the orientation and amount of frame structure 122 suitably allows various properties of each material to be enhanced. For example, because filler matrix 130 is typically lighter with a high strength to weight ratio and stronger and stiffer than most metals, club head 100 is also lighter, stiffer, and/or stronger. More particularly, in accordance with another beneficial aspect of the present invention and with reference to the exemplary embodiments of FIG. 5, apertures 124 allow the use of less material in frame structure 120, reducing the overall weight of frame structure 120. The reduction in weight of frame structure 120 thus allows redistribution of the total weight of club head 100 to change the location of the center of gravity and/or moment of inertia of club head 100.

For example, an ideal driver club head weighs about 195 g to about 200 g. Body combinations 110 in accordance with the present invention weigh about 120 g to about 140 g and a faceplate 140 weighs about 40 g to about 50 g. Thus, the combined weight of body combination 110 and faceplate 140 is about 160 g to about 190 g, leaving about 10 g to about 40 g of additional weight, such as tuning weights 200, which can be strategically added or redistributed in club head 100. Additionally, it should be noted that the forgoing values are merely exemplary and that any number of combinations, most notably with respect to the ability to redistribute weight or added tuning weights, are made possible in accordance with the present invention.

Additionally, as will be described further below, club 100 is hollow, allowing the variable positioning of tuning weights 200 within club head 100 to suitably adjust performance characteristics (such as the location of the center of gravity and moment of inertia) of club 100 as well as change the sound of club 100 via damping the structural elements of club 100.

Additionally, the configuration of apertures 124 are visible on the surface of club 100 and provide for the placement of various indicia (e.g., product name, specifications and the like) on club.

In accordance now with additional aspects of the present invention with reference back to FIG. 1, club 100 further comprises faceplate 140 connected to said body combination structure 100. Faceplate 140 is a surface which is intended to make contact with the golf ball during use, transferring energy of the swing to the ball. Faceplate 140 comprises any of numerous materials, such as steel or titanium, but may comprise many other materials, now known or as yet unknown, depending on desirable properties.

In accordance with various non-limiting embodiments of the present invention, faceplate 140 may be suitably detachable from body 110. For example, in one embodiment, body frame structure 122 comprises a faceplate aperture 128 having a perimeter 142 substantially contiguous with the perimeter of faceplate 140. Thus, when faceplate 140 is attached to body combination 110, faceplate 140 and body combination 110 integrate substantially seamlessly.

Figure 6:
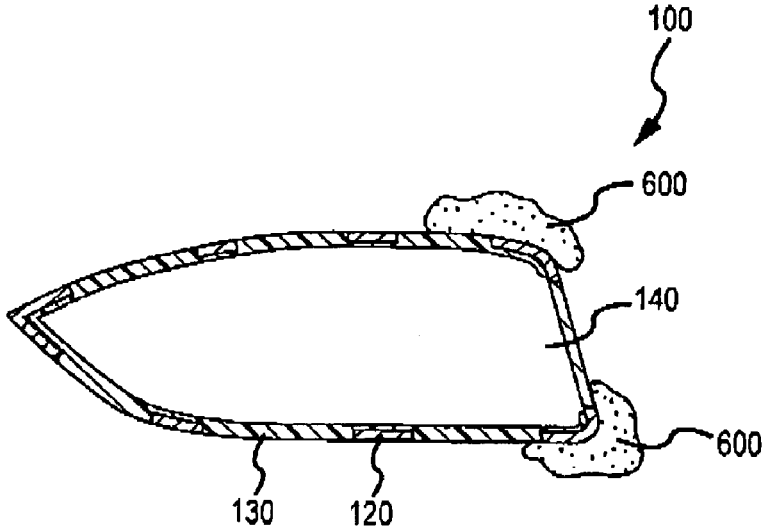
FIG. 6 illustrates heat sinks used during welding clubs in accordance with the present invention.

Additionally, in accordance with various alternative aspects of the present invention, body combination 110 may be permanently bonded with faceplate 140 through a welding process such as is illustrated in FIG. 6, and preferably, using a coolant system and/or heat sinks 600 such as a thermal putty (e.g., Bloc-It® available from LA-CO Industries, Inc./Markal Company) or other coolant system such as welding in a liquid bath (e.g., oil, water or the like) to keep filler matrix 130 of body combination 110 cool enough to avoid damage to the bond between frame structure 120 and filler matrix 130 due to the heat of welding.

As mentioned above, in various embodiments of the present invention, body combination 110 further comprises mechanisms for facilitating releasable attachment of faceplate 140 to body combination 110. For example, at least one of frame structure 120 and/or filler matrix 130 may comprise a faceplate receiving ridge 144 upon which faceplate 140 is retained. In such embodiments, receiving ridge suitably comprises a recessed "lip" which prevent faceplate 140 from passing completely within body combination 110, and, moreover may suitably assist in maintaining a striking surface 146 of faceplate 140 contiguous with outer surface 124. Moreover, in embodiments using a releasably attachable faceplate 140, no thermal protection is needed as no welding is required.

In still further embodiments, and with reference to FIG. 1, receiving ridge 144 further facilitates attachment of faceplate 140 to body combination 110. For example, receiving ridge 144 may further comprises mounting mechanisms for attaching and detaching faceplate 140. For example, mounting mechanisms may comprise body holes 148 through which screws and other similar fastening devices connect faceplate 140 to body combination 110 via corresponding faceplate holes 150.

Thus, golf heads 100 in accordance with the present invention, provide an ideal driver head large enough to provide an ideal center of gravity location and inspire confidence to the golfer, yet has a thinner and stronger face to yield a high coefficient of restitution value and is durable enough for long term use.

Likewise, heads 100 in accordance with the present invention, allow mass to be concentrated around the perimeter of club 100 and thus inertia properties can be improved, positively impacting the "forgiveness" on off center impacts.

Moreover, due to the inherent improvements in the specific stiffness/strength values of the composite materials (vs. metals), the resulting "hybrid" head body can be significantly lighter than a pure metal head. For example, using titanium and graphite/epoxy, the following material property values are attainable:

| | Titanium | Graphite/EP |
|---|---|---|
| (E) Elastic | 16 | 12 |
| (J) Yield Strength | 120 | 120 |
| (e) Density (lbs./in$^3$) | .16 | .05 |
| E/e | 100 | 240 |
| J/e | 750 | 2400 |

Such values suitably create new opportunities to achieve a hybrid structure that has similar stiffness and/or strength to known structures but with less weight. Notably, in the case of club heads 100 in accordance with the present invention, this "saved" weight can now be repositioned inside the head body to alter the location of center of gravity and/or inertia values to help improve trajectory (CG) or forgiveness on off-center hits (inertia properties) or it can be allocated to an adjustable secondary center of gravity/sound type tuning mechanism.

For example, tuning weights 200 can be positioned within club 100 to change such characteristics. For example, experienced golfers may wish to move the center of gravity of club 100 higher up the club, and more toward the crown of the club to reduce backspin, while less experienced golfers may prefer the opposite. Tuning weights may be positioned within club head 200 in any number of manners now known or as yet unknown, preferably using access through faceplate aperture 128. For example, with reference to FIG. 1, a weight retaining stud 132 is illustrated. It should be appreciated that numerous weight retaining studs may be placed in various locations in club head 100, providing the ability to not only adjust gross weight, bust also center of gravity location and moment of inertia. For purposes of illustration, however, only one stud 132 is shown. Weight retaining stud 132 is configured to allow a weight 134 to be attached. For example, in the presently described embodiment, weight 134 is a rubber, "washer-like" piece weighing approximately 30 g which is attached to stud 132 with a typical machine screw, bringing the total weight of club head 100 to the "ideal" weight of about 200 g, with a center of gravity in a desired location and/or a desired moment of inertia.

Further still the use of weights and/or damping materials attached to club head 100 suitably provides sound changing effects. For example, a weight attached to club head 100 may suitably provided a more "solid" sound when club head 100 strikes the ball, giving the impression club head 100 is not substantially hollow. Additionally, other materials may be added to the interior of club head 100 to achieve similar sound changing results. For example, club head 100 may contain some filler material such as fiberglass, silicone, rubber or other materials.

Thus, in addition to the tangible "objective" benefits of this new design/construction golf head (such as improved inertia/CG properties/magnification capabilities), several more "subjective" benefits exist as well. In addition to the ability to tune the sound characteristics by changing the type/location of materials and/or dampers, the aesthetic elements can also now be optimized.

Figure 5:
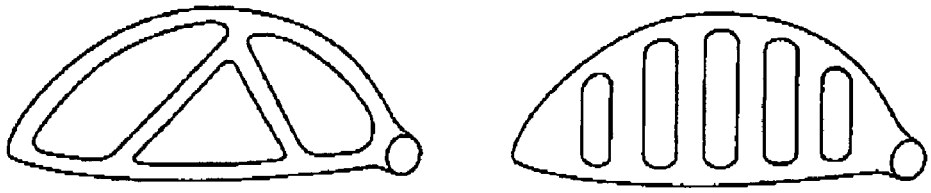
FIG. 5 illustrates various exemplary design configurations of a club in accordance with the present invention.

The surface of the club visible to the golfer at address is the upper crown. In typical pure metal or composite heads, the visual appearance is very uniform. The multi-material nature of the invention allows for contrasting elements/designs not possible before. Any combination of shapes, logos, patterns or alignment features an now be incorporated. Examples of top views are shown in FIG. 5, for a sampling of different treatments, but obviously any kind of shape or pattern could be used.

Finally, it should be appreciated that the present invention has been described above with reference to various exemplary embodiments. However, many changes, combinations and modifications may be made to the exemplary embodiments without departing from the scope of the present invention. For example, the various components may be implemented in alternate ways. These alternatives can be suitably selected depending upon the particular application or in consideration of any number of factors associated with the operation of the system. In addition, the techniques described herein may be extended or modified for use with other types of devices. These and other changes or modifications are intended to be included within the scope of the present invention.

I claim:

1. A golf club head, comprising:

a body combination having a body frame structure defining a first portion of an outer surface of the golf club head and at least one body aperture, said body frame structure encompassing an aperture filler matrix;

wherein an outer surface of said aperture filler matrix is at least partially in contact with an inner surface of said body frame structure, wherein an inner surface of said aperture filler matrix defines a hollow space, and wherein the outer surface of said aperture filler matrix defines a second portion of the outer surface of the golf club head;

a tuning weight attached to an interior surface of said body combination;

a faceplate; and wherein said body frame structure having a faceplate aperture distinct from said at least one body aperture, said faceplate aperture providing access to said hollow space and said tuning weight, said faceplate aperture further comprising a perimeter substantially coincident with said faceplate, said faceplate aperture further comprising a faceplate receiving ridge upon which said faceplate is detachably retained on said body frame structure.

2. A golf club head in accordance with claim 1, further comprising a fastening mechanism for fastening said faceplate to one of said frame structure and said filler matrix.

3. A golf club head in accordance with claim 2, wherein said fastening mechanism comprises removable and reattachable fasteners.

4. A golf club head in accordance with claim 1, wherein said tuning weight provides for an adjustable center of gravity.

5. A golf club head in accordance with claim 1, wherein said tuning weight provides for an adjustable moment of inertia.

* * * * *